US012662827B2

(12) United States Patent
Hagias et al.

(10) Patent No.: US 12,662,827 B2
(45) Date of Patent: Jun. 23, 2026

(54) WALKWAY INTEGRATED WITH COOLING SYSTEM

(71) Applicant: Seeley International Pty Ltd, Lonsdale (AU)

(72) Inventors: Diamantis Dimitris Hagias, Lonsdale (AU); Robert William Gilbert, Lonsdale (AU); Giles McDonald, Lonsdale (AU)

(73) Assignee: Seeley International Pty Ltd, Lonsdale (AU)

( * ) Notice: Subject to any disclaimer, the term of this patent is extended or adjusted under 35 U.S.C. 154(b) by 1079 days.

(21) Appl. No.: 17/742,308

(22) Filed: May 11, 2022

(65) Prior Publication Data

US 2023/0392393 A1 Dec. 7, 2023

(51) Int. Cl.
*E04G 3/22* (2006.01)
*E04G 7/30* (2006.01)

(52) U.S. Cl.
CPC ..... *E04G 3/22* (2013.01); *E04G 7/30* (2013.01)

(58) Field of Classification Search
CPC .... E04G 3/22; E04G 3/26; E04G 7/30; E04G 13/12; F24F 13/32; E04D 13/12
See application file for complete search history.

(56) References Cited

U.S. PATENT DOCUMENTS 5,820,092 A * 10/1998 Thaler ..... F24F 13/32 248/676
7,937,963 B1 5/2011 Semmes
8,360,834 B1 1/2013 Semmes
10,246,868 B2 * 4/2019 Pridham ..... E04B 1/2403
11,136,763 B2 * 10/2021 Repasky ..... E04D 13/12
(Continued)

FOREIGN PATENT DOCUMENTS

CA 3003332 A1 * 11/2018 ..... B60H 1/00378
EP 2837751 A2 2/2015
(Continued)

OTHER PUBLICATIONS

Industrial walkway work platform, retrieved from Internet on Jul. 4, 2023, published Apr. 23, 2008, https://www.alamy.com/stock-photo-industrial-walkway-work-platform-148060372.html.
(Continued)

*Primary Examiner* — David E Martinez
(74) *Attorney, Agent, or Firm* — Koenig IP Works, PLLC; Katherine Koenig

(57) ABSTRACT

A walkway for use and integration with a cooling system and methods for the assembly thereof. A walkway may include a chassis and a walkway assembly coupled to the chassis, the chassis being configured to be coupled to a cooling system. The chassis may include a frame portion that is configured to be integrated with the cooling system such that the frame portion defines at least a portion of a frame of the cooling system when the walkway is in use; a mounting rail portion coupled to the frame portion; and a plurality of walkway support sleeves coupled between the frame portion and the mounting rail portion. The walkway may also include a plurality of walkway support bars, each configured to be received within a corresponding one of the plurality of walkway support sleeves and secured against the mounting rail portion.

19 Claims, 8 Drawing Sheets

(56) References Cited

U.S. PATENT DOCUMENTS

| | | | | |
|---|---|---|---|---|
| 11,203,867 | B2 * | 12/2021 | Ferland | F24F 13/20 |
| 11,261,604 | B1 | 3/2022 | Green et al. | |
| 11,454,042 | B2 * | 9/2022 | Wyse | E04B 5/10 |
| 2014/0352342 | A1 * | 12/2014 | Magro | F24F 3/0442 29/890.03 |
| 2017/0108276 | A1 * | 4/2017 | Seawell | E04H 5/12 |
| 2019/0360719 | A1 | 11/2019 | Garg et al. | |
| 2020/0033012 | A1 | 1/2020 | Nagashima | |
| 2020/0370782 | A1 | 11/2020 | Tamboli et al. | |
| 2020/0378694 | A1 | 12/2020 | Chehade et al. | |

FOREIGN PATENT DOCUMENTS

| | | | |
|---|---|---|---|
| ES | 2218969 | | 11/2004 |
| JP | 2018132229 | A | 8/2018 |
| WO | 2016081974 | A1 | 6/2016 |

OTHER PUBLICATIONS

International Search Report and Written Opinion, issued in PCT/IB2023/054877 by the Australian Patent Office, dated Jul. 4, 2023 (12 pages).

MonkeyToe, retrieved from Internet on Jul. 4, 2023, using Wayback Machine, published by Dec. 22, 2019, http://web.archive.org/web/20191222215538/https://www.monkeytoe.com.au/wp-content/uploads/2019/07/5.jpg.

Permacold01, retrieved from Internet on Jul. 4, 2023, using Wayback Machine, published by May 14, 2019, http://web.archive.org/web/20190514222857/https://www.process-cooling.com/ext/resources/issues/2019/May/PC0519_ePublishing_Permacold01.jpg?1556910105.

Roof Access WA, retrieved from Internet on Jul. 4, 2023, using Wayback Machine, published by Mar. 5, 2022, http://web.archive.org/web/20220305003346/https://www.roofaccesswa.com.au/wp-content/uploads/2021/03/IMG_5670.jpg.

* cited by examiner

WALKWAY INTEGRATED WITH COOLING SYSTEM

CROSS-REFERENCE TO RELATED APPLICATIONS

N/A.

GOVERNMENT RIGHTS STATEMENT

N/A.

FIELD

The present technology is related generally to a walkway for use and integration with a cooling system and methods for the assembly and installation thereof.

BACKGROUND

Many commercial, residential, and industrial facilities include temperature regulation and/or air circulation systems, such as cooling systems including evaporative cooling systems. Such cooling systems can be large and complex to provide enough cooling power, especially when used for commercial and industrial facilities. Additionally, these cooling systems are frequently mounted to a roof, outdoor platform, and/or other surface or location that is difficult or dangerous to access for installation, repair, or maintenance.

SUMMARY

Some embodiments advantageously provide a system and method for coupling or integrating a walkway to or with a cooling system. In one embodiment, a walkway includes: a chassis; and a walkway assembly coupled to the chassis, the chassis being configured to be coupled to a cooling system.

In one aspect of the embodiment, the chassis includes a plurality of frame members arranged in a configuration that follows a shape of at least a portion of the cooling system.

In one aspect of the embodiment, the chassis is configured to replace at least a portion of the cooling system.

In one aspect of the embodiment, the chassis includes: a frame portion; and a mounting rail portion coupled to the frame portion.

In one aspect of the embodiment, the chassis is further configured to be coupled to a mounting surface.

In one aspect of the embodiment, the mounting rail portion is positioned between the frame portion and the mounting surface when the walkway is in use.

In one aspect of the embodiment, the chassis further includes at least one mounting foot coupled to the mounting rail portion, the at least one mounting foot being configured to be coupled to the mounting surface.

In one aspect of the embodiment, the chassis further includes: at least one walkway support sleeve; and at least one walkway support bar sized and configured to engage with the at least one walkway support sleeve.

In one aspect of the embodiment, the mounting rail portion includes two mounting rails that are at least substantially parallel to each other.

In one aspect of the embodiment, each of the at least one walkway support sleeve defines a channel that is sized and configured to receive one of the at least one walkway support bar therein and to secure the at least one walkway support bar against the mounting rail portion.

In one aspect of the embodiment, the frame portion has a longitudinal axis, each of the at least one walkway support sleeve having a longitudinal axis that is at least substantially orthogonal to the longitudinal axis of the frame portion.

In one aspect of the embodiment, at least a portion of each of the at least one walkway support bar extends beyond the chassis when the at least one walkway support bar is received within the channel of the at least one walkway support sleeve and secured against the mounting rail portion.

In one aspect of the embodiment, the walkway assembly includes: a plurality of walkway platforms, at least some of the plurality of walkway platforms being supported by the at least a portion of each of the at least one walkway support bar that extends beyond the chassis; and a handrail assembly, the handrail assembly including a plurality of handrail elements and a plurality of upright stanchions.

In one aspect of the embodiment, each of the plurality of upright stanchions is coupled to at least one handrail element and one of the at least one walkway support bar.

In one aspect of the embodiment, the walkway further includes a plurality of parapet modules, each of the plurality of parapet modules being coupled to the walkway assembly.

In one aspect of the embodiment, each of the plurality of parapet modules includes: a panel; and a mounting frame coupled to the panel and the walkway assembly.

In one embodiment, a walkway for use with a cooling system includes: a chassis, the chassis including: a frame portion, the frame portion being configured to be integrated with the cooling system such that the frame portion defines at least a portion of a frame of the cooling system when the walkway is in use; a mounting rail portion coupled to the frame portion; and a plurality of walkway support sleeves coupled between the frame portion and the mounting rail portion; a plurality of walkway support bars, each of the plurality of walkway support bars being configured to be received within a corresponding one of the plurality of walkway support sleeves and secured against the mounting rail portion, at least a portion of each of the walkway support bars extending beyond the frame portion; and a walkway assembly coupled to the chassis, the walkway assembly including: a plurality of walkway platforms, at least some of the plurality of walkway platforms being supported by the at least a portion of each of the walkway support bars that extends beyond the frame portion; a plurality of upright stanchions, each of the plurality of upright stanchions being coupled to a corresponding one of the plurality of walkway support bars; and a handrail element coupled to each of the plurality of upright stanchions.

In one aspect of the embodiment, the walkway further includes a plurality of mounting feet coupled to the mounting rail portion of the chassis.

In one aspect of the embodiment, the walkway further includes a plurality of parapet modules, each of the plurality of parapet modules being coupled to the walkway assembly and including: a panel; and a mounting frame coupled to the panel and the walkway assembly.

In one embodiment, a method of assembling an integrated walkway includes: assembling a chassis from a plurality of frame elements, at least some of the frame elements defining at least a portion of a frame of a cooling system, the chassis including a plurality of walkway support sleeves, each of the plurality of walkway support sleeves defining a channel; inserting each of a plurality of walkway support bars into a corresponding one of the plurality of walkway support sleeves such that at least a portion of each of the plurality of walkway support bars extends beyond the chassis; arranging a plurality of walkway platforms such that the plurality of walkway support platforms is supported by the at least a portion of each of the plurality of walkway support bars that extends beyond the chassis and the plurality of walkway platforms extends around at least a portion of the cooling system; coupling each of a plurality of upright stanchions to a corresponding one of the plurality walkway support bars; and coupling a handrail assembly to the plurality of upright stanchions such that a space is defined between the handrail assembly and the cooling system.

BRIEF DESCRIPTION OF THE DRAWINGS

A more complete understanding of embodiments described herein, and the attendant advantages and features thereof, will be more readily understood by reference to the following detailed description when considered in conjunction with the accompanying drawings wherein.

DETAILED DESCRIPTION

Figure 1:
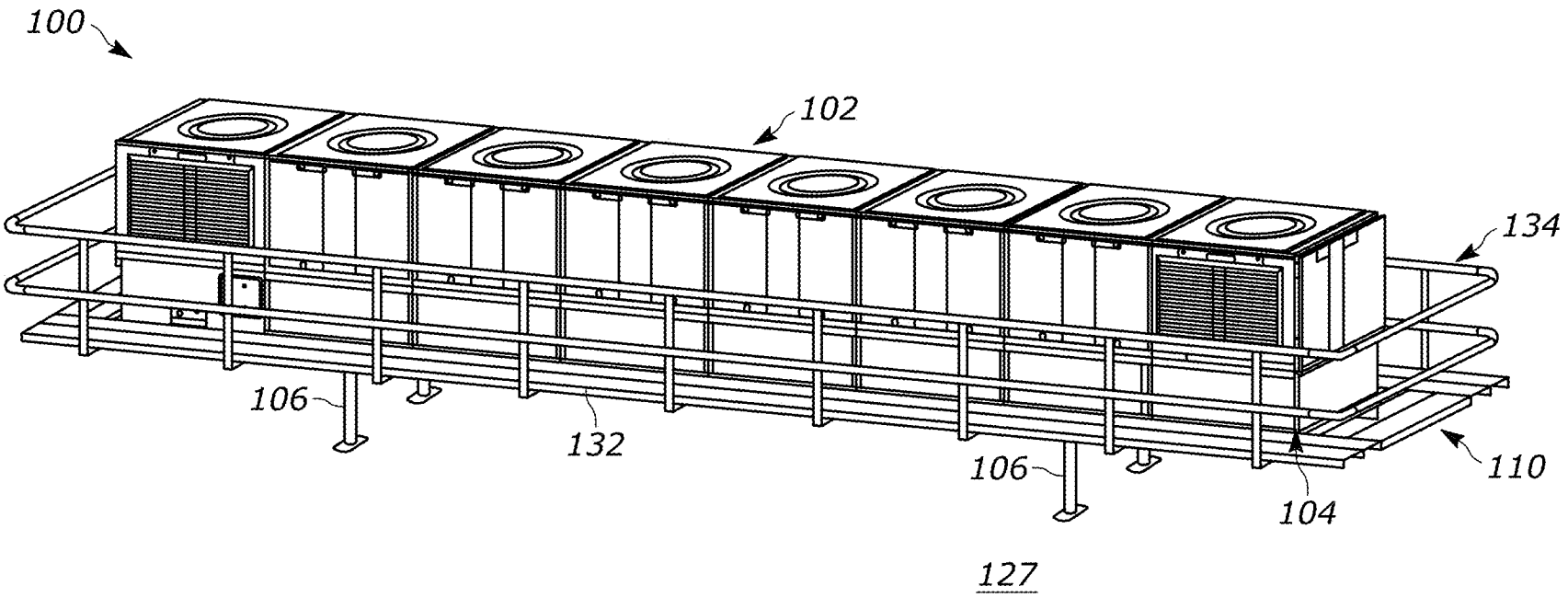
FIG. 1 shows a perspective view of an exemplary integrated walkway, shown with an exemplary cooling system, in accordance with the present disclosure.

Before describing in detail exemplary embodiments, it is noted that the embodiments reside primarily in combinations of apparatus components and steps related to a walkway for use and integration with a cooling system and methods for the assembly and installation thereof. Accordingly, the system and method components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements. The terminology used herein is for the purpose of describing particular embodiments only and is not intended to be limiting of the concepts described herein. As used herein, the singular forms "a", "an" and "the" are intended to include the plural forms as well, unless the context clearly indicates otherwise. It will be further understood that the terms "comprises," "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

Referring now to the figures in which like reference designators are used for like elements, an integrated walkway 100 is shown in FIG. 1. The integrated walkway 100 is configured for use with a mechanical system where human access for maintenance, repair, and/or installation may be difficult, dangerous, or impractical. In one non-liming example, the integrated walkway 100 is configured for integration and use with a cooling system 102, such as the exemplary multi-unit evaporative cooling system shown in FIG. 1. However it will be understood that the integrated walkway 100 may be configured for use with certain components (for example, roof-mounted fans, blowers, generators, electrical boxes, ductwork and conduits, and/or other components) of other commercial, residential, and/or industrial temperature regulation systems including, but not limited to, HVAC. Further, the integrated walkway 100 is a walkway that is configured to be attached to or integrated with a mechanical device, such as a cooling system, and is therefore referred to herein as an integrated walkway. The integrated walkway 100 is modular and may be configured to be coupled to any size cooling system.

Figure 7:
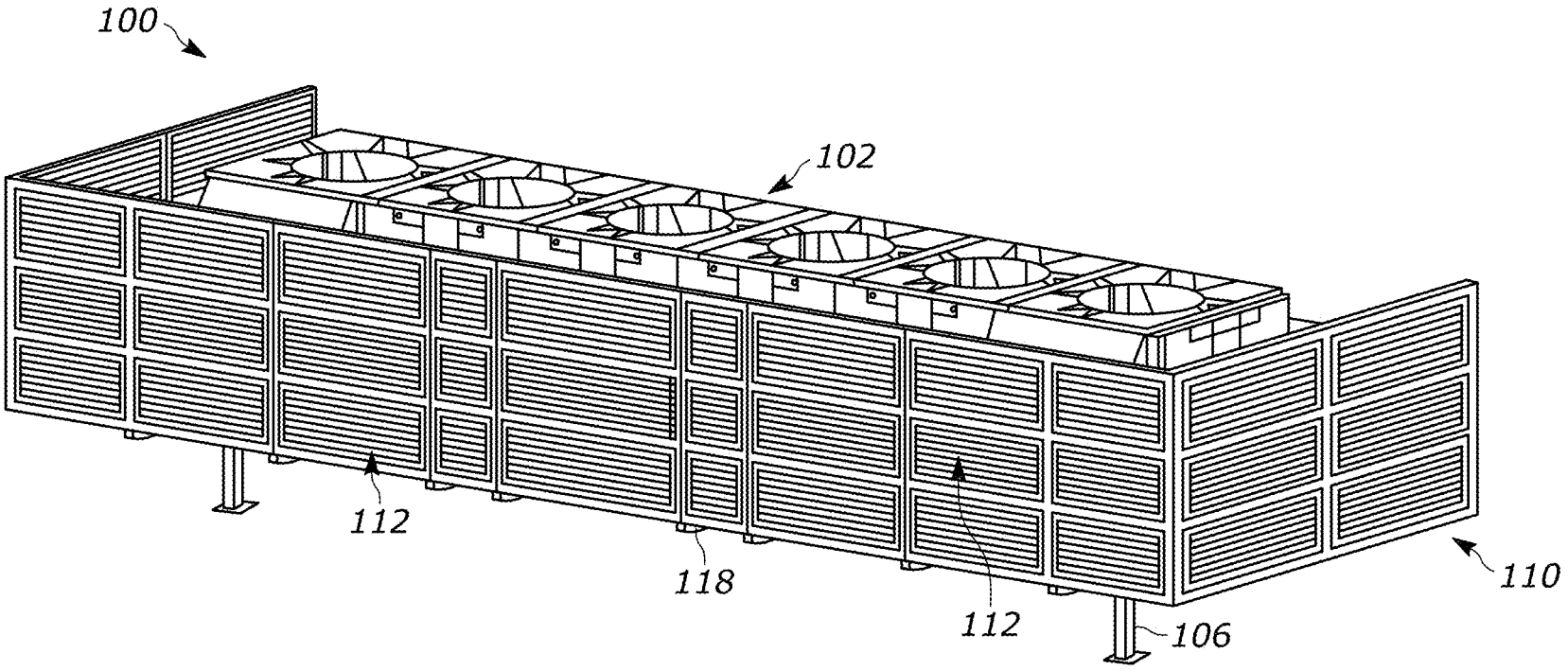
FIG. 7 shows the integrated walkway with a plurality of parapet modules, in accordance with the present disclosure.

Continuing to refer to FIG. 1, and as discussed in greater detail below, the integrated walkway 100 generally includes a chassis 104, one or more mounting feet 106, one or more support bars 108, and a walkway assembly 110. Additionally, in some embodiments, the integrated walkway 100 also includes one or more parapet modules 112, as shown in FIG. 7. In one embodiment, the chassis 104 is configured to be coupled to a frame of the cooling system 102 and/or to replace one or more components of the cooling system 102 such that the chassis 104, walkway assembly 110, and other components of the integrated walkway 100 are securely coupled to (and, thus, integrated with) the cooling system 102. For example, the chassis 104 may be coupled to a frame of the cooling system 102 by welding, chemical welding, brazing, soldering, adhesive bonding, and/or by fastening elements such as screws, bolts, fasteners, clips, clamps, or the like. In some embodiments, at least a portion of the chassis 104 defines at least a portion of the frame of the cooling system 102. Further, the integrated walkway 100 is coupled to the cooling system 102 such that the integrated walkway 100 can support the weight of at least the cooling system 102 and at least one technician or user.

Figure 2:
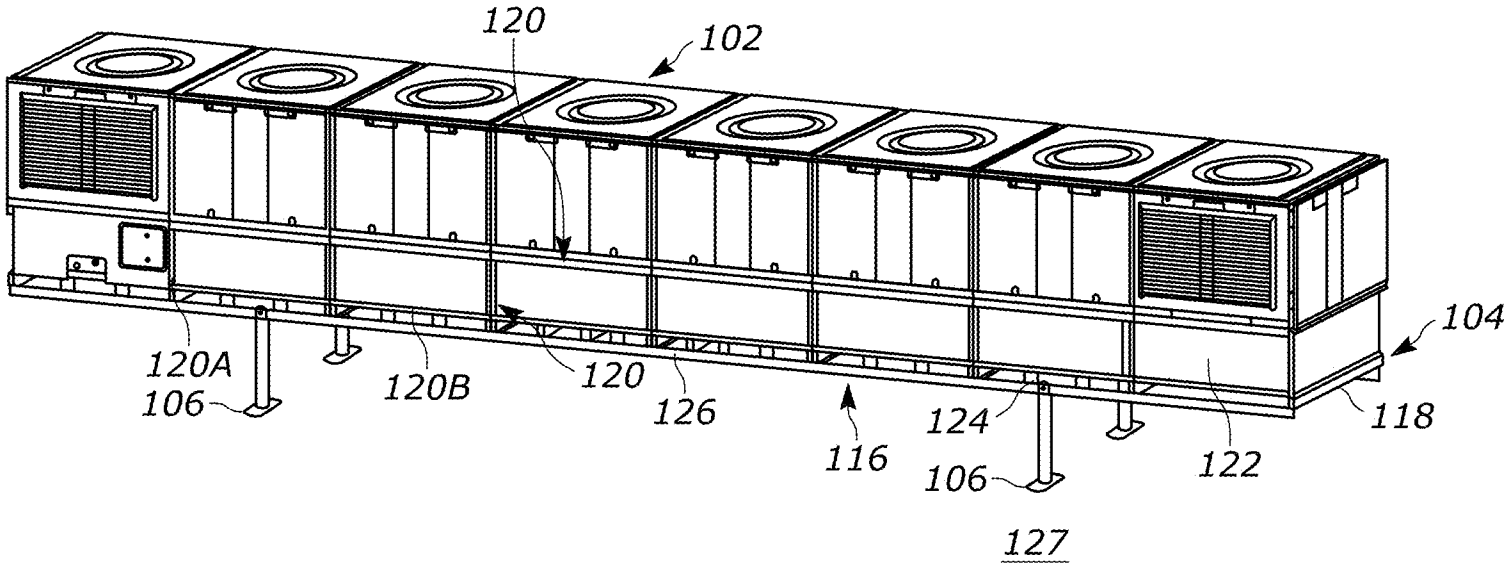
FIG. 2 shows a perspective view of a chassis of the integrated walkway of FIG. 1, a cooling system being coupled to the chassis, in accordance with the present disclosure.
Figure 3:
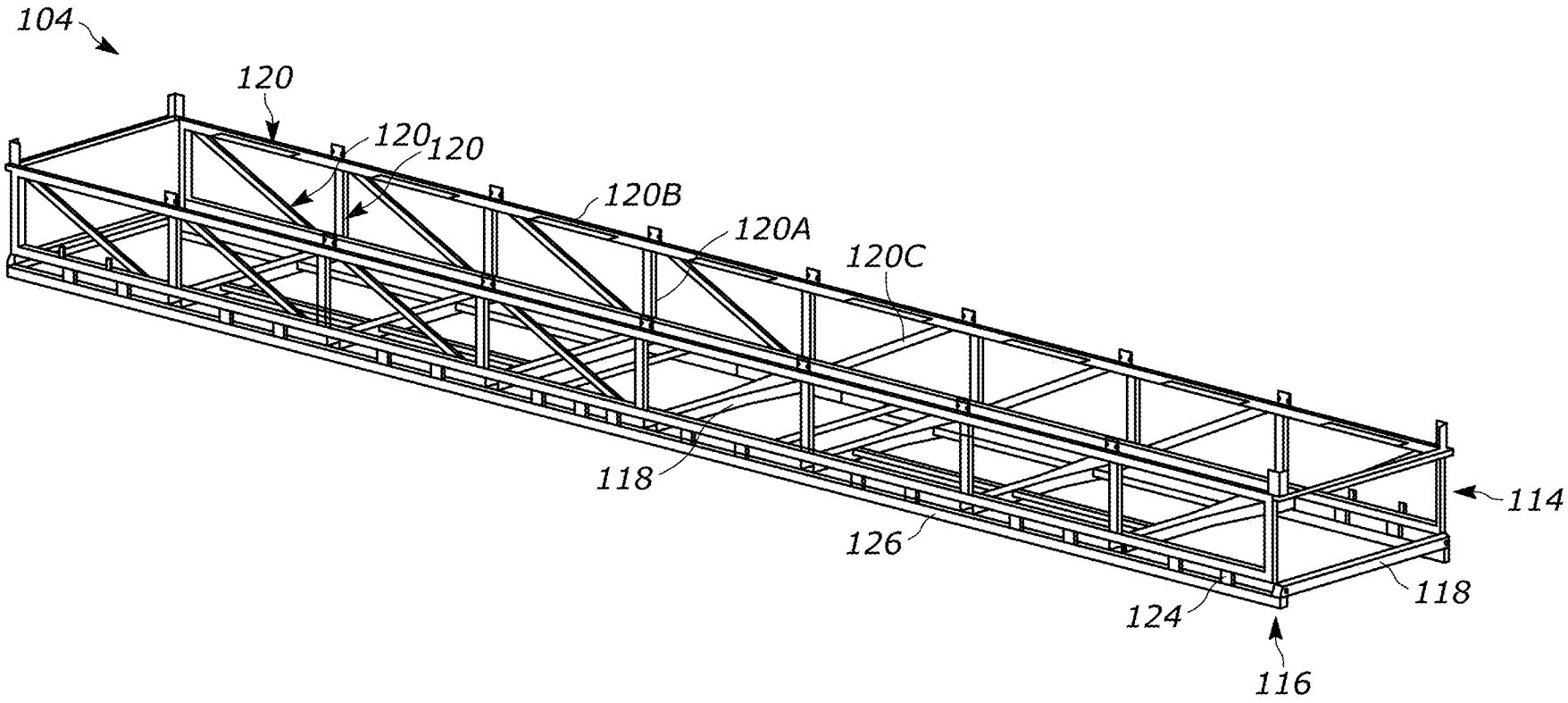
FIG. 3 shows a perspective view of an exemplary chassis of the integrated walkway, in accordance with the present disclosure.
Figure 4:
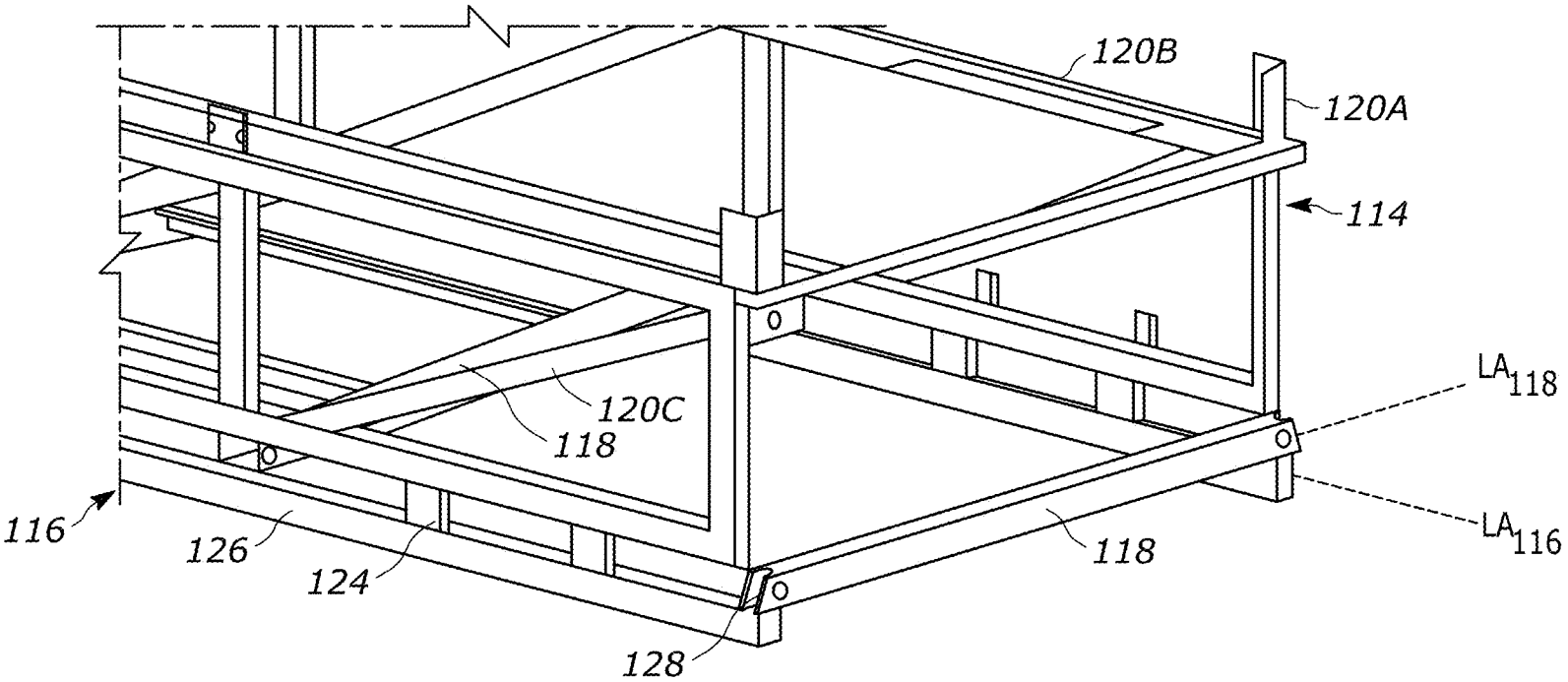
FIG. 4 shows a close-up view of a portion of the exemplary chassis of FIG. 3, in accordance with the present disclosure.

Referring now to FIGS. 2-4, the chassis is shown in greater detail. In some embodiments, the chassis 104 is coupled to a cooling system 102 such that the chassis 104 replaces and/or supplements one or more frame components of the cooling system and defines at least a part of the frame of the cooling system. The size, shape, and/or configuration of components of the chassis 104 may be chosen to accommodate any of a variety of cooling systems. In one embodiment, the chassis 104 includes a frame portion 114, a mounting rail portion 116, and one or more walkway support sleeves 118. In one embodiment, the frame portion 114 and/or the mounting rail portion 116 define at least a portion of the perimeter of the chassis 104. In one embodiment, the chassis 104 is at least partially composed of a rigid material such as steel, aluminum, or other metal. However, it will be understood that other materials may be used, including, but not limited to, plastics, wood, other metals, and/or combinations thereof. It will also be understood that chassis configurations other than that shown in the figures may be used. For example, the chassis 104 may be sized and configured for use with a smaller cooling system, for cooling systems with alternative footprint configurations (such as footprints having square, round, or other polygonal shapes), for electrical systems, for non-cooling mechanical systems, and/or for other systems or devices.

Continuing to refer to FIGS. 2-4, in one embodiment, the frame portion 114 is sized and configured similarly to the cooling system 102 to which it is coupled, will be coupled, and/or to which it is configured to be coupled. For example, the frame portion 114 may have the same size, shape, and/or configuration as at least a base of the cooling system 102 (for example, a rectangular or elongate shape, as shown in FIG. 2). In one embodiment, the frame portion 114 includes a plurality of frame members 120 that are arranged in a configuration that follows a shape or configuration of at least a portion of the cooling system 102 to which the integrated walkway 100 is coupled, will be coupled, and/or to which it is configured to be coupled (that is, both the frame portion 114 and the portion of the cooling system 102 to which the frame portion 114 is attached have the same, or approximately the same, dimensions). However, it will be understood that other configurations of the frame portion 114 may be used, such as configurations wherein the frame portion 114 is smaller than or larger than a perimeter shape and/or dimensions of the cooling system. In one embodiment, the plurality of frame members 120 includes at least one frame member that extends upward in a vertical, or at least substantially vertical, direction when the integrated walkway 100 is in use (vertical frame member 120A). In one embodiment, the plurality of frame members 120 also includes at least one frame member that extends in a horizontal, or at least substantially horizontal, direction (horizontal frame member 120B) and/or at least one frame member that extends in a diagonal direction to stabilize the at least one vertical frame member 120A (diagonal frame member 120C). In one non-limiting example, as shown in FIG. 2, the chassis 104 includes a plurality of vertical frame members 120A, a plurality of horizontal frame members 120B, and a plurality of diagonal frame members 120C, and the frame members form at least a portion (for example, the lower portion) of the base of the cooling system 102 to form an integrated frame portion 114 of the cooling system 102. The chassis 104 may be removably and/or permanently coupled to the cooling system 102. Additionally, one or more panels 122 may be coupled to the chassis 104 to enclose the integrated frame portion 114 and, optionally, to define one or more ducts and/or airflow pathways of the cooling system 102.

Continuing to refer to FIGS. 2-4, in one embodiment the mounting rail portion 116 is coupled to at least a portion of the frame portion 114. In one embodiment, the mounting rail portion 116 is coupled to the bottom portion of the frame portion 114 when the chassis 104 is in use, such as through one or more coupling elements 124 between the mounting rail portion 116 and one or more of the horizontal frame members 120B of the frame portion 114. In one non-limiting example, the mounting rail portion 116 includes two mounting rails 126 extending parallel, or at least substantially parallel, to each other (±20°) and parallel, or at least substantially parallel, to at least some of the horizontal frame members 120B (±20°). However, in other embodiments, such as when the cooling system 102 and/or the mounting surface has an irregular shape, the mounting rails 126 may not be parallel to each other or to the horizontal frame members. In one embodiment, the mounting rail portion 116 is removably or permanently coupled to the frame portion 114 by welding, chemical welding, brazing, soldering, and/or adhesive bonding. However, it will be understood that other suitable arrangements or configurations, as well as means and/or locations of attachment, of the plurality of frame members 120, coupling elements 124, and/or mounting rail portion 116 may be used that provide a stable coupling between components of the integrated walkway 100 and/or between the integrated walkway 100 and the cooling system 102.

Continuing to refer to FIGS. 2-4, in one embodiment the chassis 104 includes one or more mounting feet 106 coupled to the mounting rail portion 116 to allow the integrated walkway 100 to be secured to a mounting surface 127. In one embodiment, each mounting foot 106 is coupled to a mounting rail 126 such that it extends downward (approximately 90°±10°) from the chassis 104 when the chassis 104 is coupled to the mounting surface 127, such as scaffolding or beams, a roof, a cooling system support platform, a floor, or other horizontal, or at least substantially horizontal, surface or structure. Additionally or alternatively, each mounting foot 106 is coupled to the mounting rail portion 116 to enable the chassis 104 to be coupled to a non-horizontal surface, such as a sloped roof. Each mounting foot 106 is configured to be coupled to the mounting rail portion 116 such that the mounting foot 106 extends from the chassis 104 in orientations other than approximately 90°, and in the same or different direction as one or more other mounting feet 106. For example, the mounting feet 106 may be coupled to the mounting rail portion 116 by welding, chemical welding, brazing, soldering, adhesive bonding, and/or by fastening elements such as screws, bolts, fasteners, clips, clamps, ball-and-socket joints, sleeves, followers, or the like. Additionally, in one embodiment each mounting foot 106 is rotatable relative to the mounting rail portion 116, slidable along the mounting rail portion 116, telescoping to achieve a variety of lengths, and/or includes other features that allow the mounting feet 106 to be positioned in configurations suitable for the cooling system 102 and/or the mounting surface 127. Thus, the integrated walkway 100 is configured to be mounted to any of a variety of mounting surfaces, including non-horizontal and/or irregular mounting surfaces. However, it will be understood that other suitable arrangements or configurations, as well as means and/or locations of attachment, of the mounting feet 106 and/or mounting rail portion 116 may be used that provide a stable coupling between components of the integrated walkway 100 and/or between the integrated walkway 100 and the cooling system 102.

Figure 5:
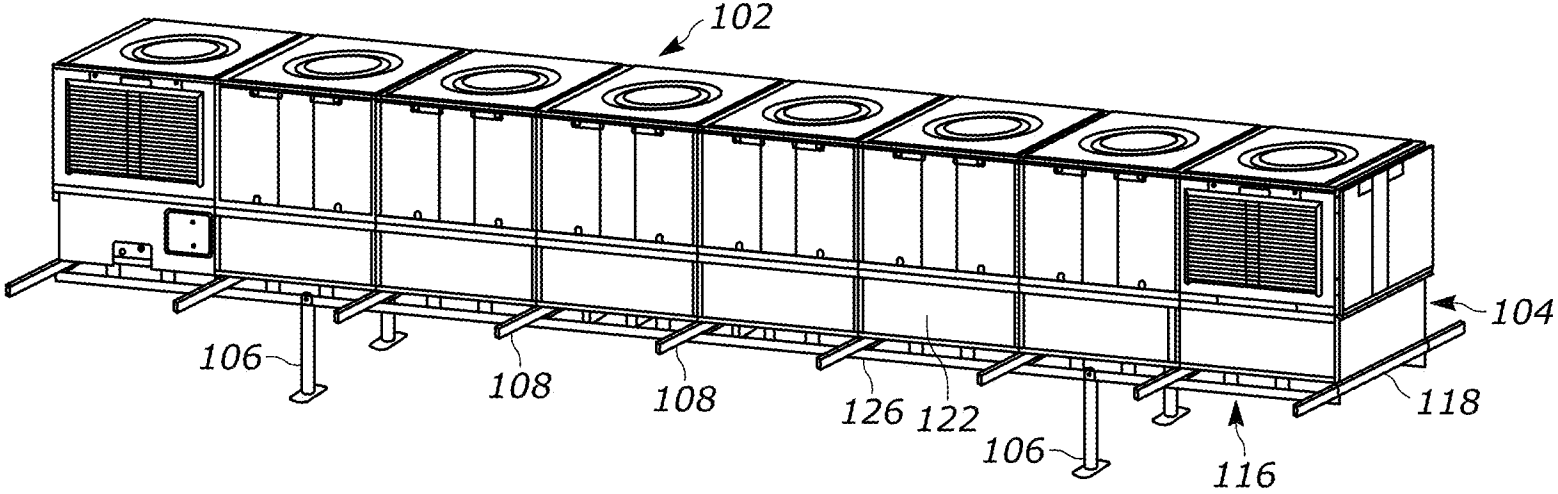
FIG. 5 shows a perspective view of the exemplary chassis of the integrated walkway of FIG. 1, a cooling system being coupled to the chassis, the chassis including a plurality of support bars, in accordance with the present disclosure.

Continuing to refer to FIGS. 2-4, and with reference to FIG. 5, in one embodiment the one or more walkway support sleeves 118 includes a plurality of walkway support sleeves 118. In one embodiment, each walkway support sleeve 118 has a longitudinal axis $LA_{118}$ that extends orthogonally, or at least substantially orthogonally, to a longitudinal axis $LA_{116}$ of the mounting rail portion 116 (for example, orthogonally to one or more mounting rails 126). In one embodiment, each walkway support sleeve 118 extends between and is removably or permanently coupled to, the two mounting rails 126. Each walkway support sleeve 118 is configured to engage with a walkway support bar 108. In one embodiment, each walkway support sleeve 118 generally is U-shaped in cross section to define a channel 128 along the length (that is, along the longitudinal axis $LA_{118}$) of the walkway support sleeve 118, such that the channel 128 is sized and shaped to receive a walkway support bar 108 therein. Further, in one embodiment (as shown in FIG. 4), each walkway support sleeve 118 is coupled to an upper surface of the mounting rail portion 116, between the mounting rail portion 116 and the frame portion 114, and oriented such that the channel 128 opens downward, toward the mounting rail portion 116. In this way, when a walkway support bar 108 is received within the channel 128 of the walkway support sleeve 118, the walkway support bar 108 is retained within the channel 128 by, or is secured against, the mounting rail portion 116 (as shown in FIG. 5). However, it will be understood that other suitable arrangements or configurations, as well as means and/or locations of attachment, of the walkway support sleeves 118, walkway support bars 108, and/or mounting rail portion 116 may be used that provide a stable coupling between components of the integrated walkway 100 and/or between the integrated walkway 100 and the cooling system 102.

Figure 6:
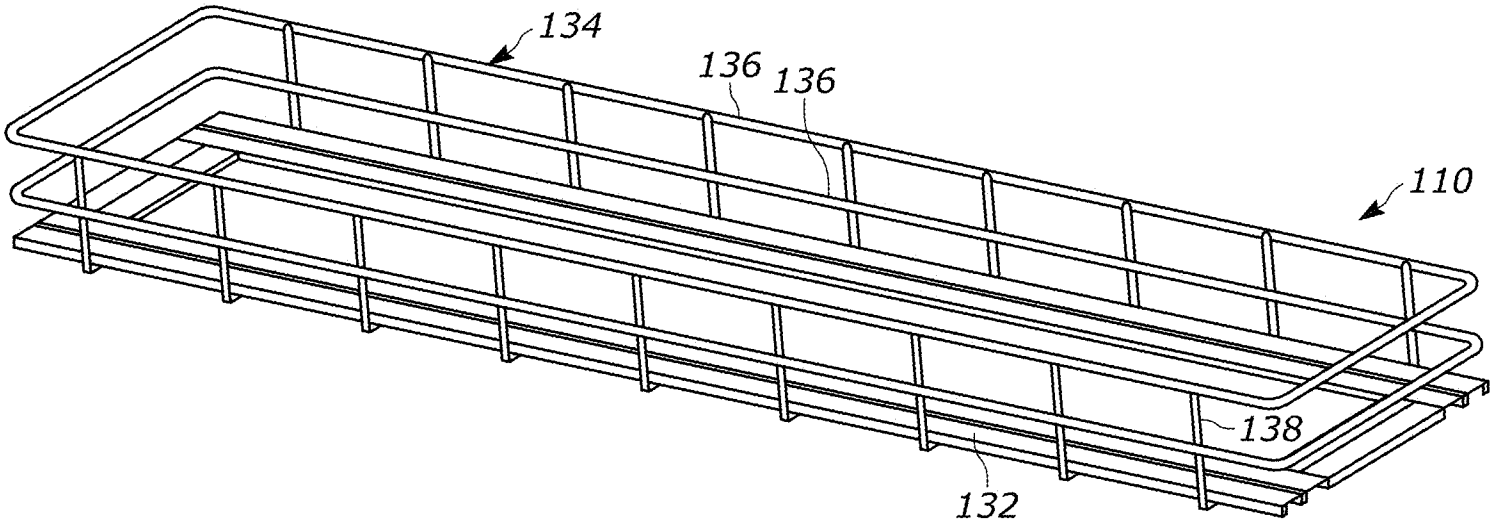
FIG. 6 shows a walkway assembly of the integrated walkway, in accordance with the present disclosure.

Referring now to FIG. 6, the walkway assembly 110 is shown. In one embodiment, the walkway assembly 110 is modular to accommodate any of a variety of cooling systems (and to be coupled to any size, shape, and/or configuration of chassis 104). In one embodiment, the walkway assembly 110 generally includes a plurality of walkway platforms 132 and a handrail assembly 134. In one non-limiting example, the walkway assembly 110 may be assembled to extend around an entire perimeter of a cooling system 102. However, it will be understood that other configurations may be used, such as a walkway assembly 110 that extends around only a portion of the cooling system perimeter, such as when the cooling system 102 abuts a wall or other structure along at least one side. Further, the walkway assembly 110 is configured to allow a technician or other user to be enclosed by the handrail assembly 134 and to securely and safely walk around or access at least a portion of the cooling system 102 for maintenance, repair, and/or installation of the cooling system.

Continuing to refer to FIG. 6, in one embodiment the handrail assembly 134 includes at least one handrail element 136 and a plurality of upright stanchions 138. In one embodiment, the at least one handrail element 136 includes a plurality of handrail elements 136 form a frame that defines the perimeter of the walkway assembly 110 when the walkway assembly 110 is assembled, such that a space is formed between the handrail assembly 134 and the cooling system 102 that is sized to be usable by a technician or other user (that is, the technician may walk along the walkway platforms between the handrail assembly and the cooling system. One non-limiting example of a configuration of the handrail assembly 134 is shown in FIG. 6.

Continuing to refer to FIG. 6, in one embodiment each of the plurality of upright stanchions 138 is coupled to at least one handrail element 136 and one of the walkway support bars 108 coupled to the frame portion 114. In one embodiment, each walkway support bar 108 includes a first end and a second end opposite the first end, and each of the first and second ends is attached to a different upright stanchion 138. In an alternative embodiment, only one of the first end and the second end of each walkway support bar 108 is attached to an upright stanchion 138. The upright stanchions may be coupled to the walkway support bars 108 by welding, chemical welding, brazing, soldering, adhesive bonding, and/or by fastening elements such as screws, bolts, fasteners, clips, clamps, or the like. Further, in one embodiment each walkway support bar 108 extends beyond the chassis 104 at both the first and second ends (that is, each walkway support bar 108 is wider than the frame portion 114 and the mounting rail portion 116 of the chassis 104). In one embodiment, the plurality of walkway platforms 132 are laid across, supported by, and coupled to at least the portion(s) of the walkway support bars 108 that extend beyond the chassis 104, as shown in FIG. 1. Thus, through the walkway support bars 108 and the upright stanchions 138, the walkway assembly 110 is securely coupled to the chassis 104 and, therefore, to the cooling system 102. In one embodiment, each walkway platform 132 is composed of a rigid or substantially rigid material, such as metal, wood, wood composite, plastic, and/or combinations thereof.

Referring now to FIG. 7, an integrated walkway 100 with a plurality of parapet modules 112 is shown. Each parapet module 112 may be removably or permanently coupled to the walkway assembly 110 to provide privacy and/or aesthetic appeal to the integrated walkway 100 and/or cooling system 102. For example, the parapet modules 112 may be used to disguise or obscure the cooling system 102 and to make the integrated walkway 100 visually similar to the building or other structure to which the integrated walkway 100 and cooling system 102 are attached or mounted. In one embodiment, each parapet module 112 includes a panel 140 and a mounting frame 142.

Figure 8:
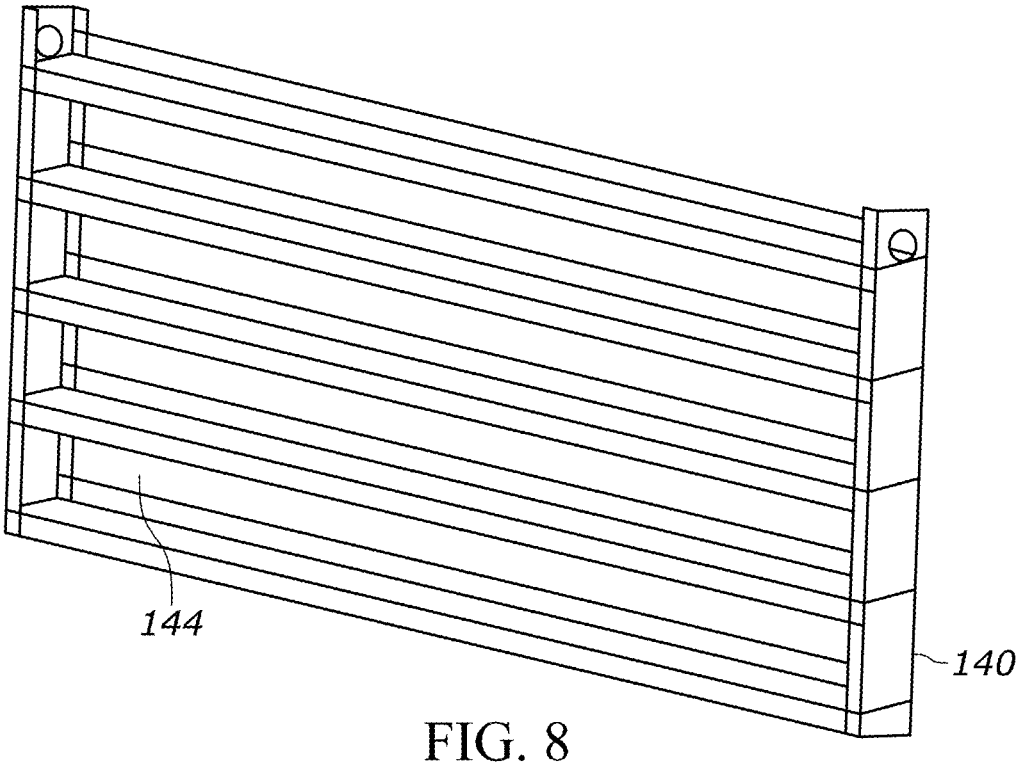
FIG. 8 shows an exemplary panel of a parapet module.

Referring now to FIG. 8, an exemplary panel 140 is shown. In one embodiment, each panel 140 includes one or more slots, holes, openings or other apertures 144 to allow air to freely flow therethrough. For example, each panel 140 may be assembled from a plurality of elements to form a slatted panel, as shown in FIG. 8. In other embodiments, each panel 140 may be solid and/or covered in a textile, plant material (such as living plants), or other covering to obscure the cooling system 102. In other embodiments, each panel 140 may be formed of a woven or meshed material (such as woven, braided, or meshed metal wire or cables, non-metal cording, plastic mesh, or other materials). In some embodiments, each panel is composed of a rigid material such as metal, wood, wood composite, plastic, or the like. It will be understood that each panel 140 may be chosen to provide a desired aesthetic, whether to obscure/blend in the integrated walkway 100 and/or cooling system 102 or to draw attention to it as a design element, and the panels 140 may be the same or different than each other.

Figure 9:
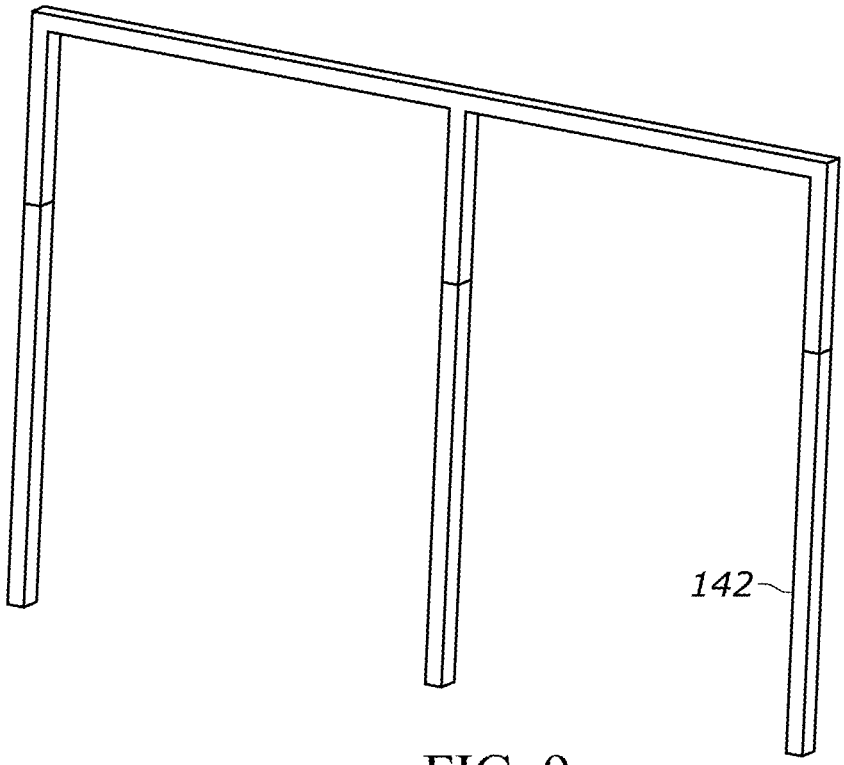
FIG. 9 shows an exemplary mounting frame of a parapet module.

Referring now to FIG. 9, an exemplary mounting frame 142 is shown. In one embodiment, each panel 140 is coupled to at least one mounting frame 142. The mounting frame 142 is sized and configured to provide support for the panel 140 and to couple the panel 140 to the walkway assembly 110. In one embodiment, each mounting frame 142 is configured to be removably or permanently attached to at least one handrail element 136, to at least one upright stanchion 138, to at least one walkway support bar 108, to the frame portion 114 of the chassis 104, and/or to at least one walkway platform 132 of the walkway assembly 110. For example, each mounting frame 142 may be coupled to the walkway assembly 110 and/or to the chassis 104 by welding, chemical welding, brazing, soldering, adhesive bonding, and/or by fastening elements such as screws, bolts, fasteners, clips, clamps, or the like. In one embodiment, each mounting frame is composed of a rigid material such as metal, wood, wood composite, plastic, and/or combinations thereof.

In one exemplary method of assembly or installation, the chassis 104 is assembled from the plurality of frame elements (to form the frame portion), the mounting rail portion (for example, two or more mounting rails), and a plurality of walkway support sleeves, as shown in FIGS. 2-4. In some embodiments, at least some frame elements are coupled to a frame of a cooling system. In some embodiments, at least some components of a frame of a cooling system are replaced with at least some of the frame elements, such that the frame portion defines at least a portion of the frame of the cooling system. In some embodiments, at least a portion of a frame of a cooling system is constructed from the plurality of frame elements. In any embodiment, the chassis is securely coupled to the cooling system. In one embodiment, a plurality of mounting feet are coupled to the mounting rail portion, in a configuration depending on the characteristics of the installation site (such as slope, mounting surface material or configuration, and/or other characteristics). In one embodiment, the integrated chassis and cooling system are assembled at the installation site, but in another embodiment the integrated chassis and cooling system are moved to the installation site after assembly (such as by crane, forklift, or the like). In one embodiment, each of a plurality of walkway support bars is inserted into a corresponding one of the plurality of walkway support sleeves such that at least a portion of each of the plurality of walkway support bars extends beyond the chassis, and each of the plurality of walkway support bars is secured between the corresponding one of the plurality of walkway support sleeves and the mounting rail portion. The walkway assembly is then coupled to the chassis. In one embodiment, a plurality of walkway platforms is arranged such that the plurality of walkway support platforms is supported by (and, in some embodiments, coupled to) the at least a portion of each of the plurality of walkway support bars that extends beyond the chassis and the plurality of walkway platforms extends around at least a portion of the cooling system. In one embodiment, each of a plurality of upright stanchions is coupled to a corresponding one of the plurality walkway support bars. In some embodiments, each walkway support bar is coupled to a first upright stanchion at a first end and is coupled to a second upright stanchion at a second end, but in other embodiments each walkway support bar is coupled to only one upright stanchion. In one embodiment, the handrail assembly is coupled to the plurality of upright stanchions such that a space is defined between the handrail assembly and the cooling system. The walkway assembly may be coupled to the chassis before or after the chassis and cooling system are positioned at the installation site. Optionally, in one embodiment a plurality of parapet modules are coupled to the walkway assembly, to the chassis, and/or to the walkway support bars. In some embodiments, the plurality of parapet modules are assembled to obscure or camouflage at least a portion of the cooling system.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention.

What is claimed is:

1. A walkway comprising:

a chassis; and a plurality of walkway support bars coupled to the chassis, each of the walkway support bars being wider than the chassis such that each of the walkway support bars extends bilaterally beyond the chassis; and a walkway assembly coupled to the chassis, the walkway assembly including a plurality of walkway platforms, at least some of the plurality of walkway platforms being supported by the at least a portion of each of the walkway support bars that extends beyond the chassis on both a first side of the chassis and a second side of the chassis opposite the first side, the chassis being configured to be coupled to a cooling system.

2. The walkway of claim 1, wherein the chassis includes a plurality of frame members arranged in a configuration that follows a shape of at least a portion of the cooling system.

3. The walkway of claim 1, wherein the chassis is configured to replace at least a portion of the cooling system.

4. The walkway of claim 1, wherein the chassis includes:

a frame portion; and a mounting rail portion coupled to the frame portion.

5. The walkway of claim 4, wherein the chassis is further configured to be coupled to a mounting surface.

6. The walkway of claim 5, wherein the mounting rail portion is positioned between the frame portion and the mounting surface when the walkway is in use.

7. The walkway of claim 6, wherein the chassis further includes at least one mounting foot coupled to the mounting rail portion, the at least one mounting foot being configured to be coupled to the mounting surface.

8. The walkway of claim 4, wherein the chassis further includes:

a plurality of walkway support sleeves, each of the plurality of walkway support bars being sized and configured to engage with a corresponding one of the plurality of walkway support sleeves.

9. The walkway of claim 8, wherein the mounting rail portion includes two mounting rails that are at least substantially parallel to each other.

10. The walkway of claim 9, wherein each of the plurality of walkway support sleeves defines a channel that is sized and configured to receive one of the plurality of walkway support bars therein and to secure the one of the plurality of walkway support bars against the mounting rail portion.

11. The walkway of claim 10, wherein the frame portion has a longitudinal axis, each of the plurality of walkway support sleeves having a longitudinal axis that is at least substantially orthogonal to the longitudinal axis of the frame portion.

12. The walkway of claim 10, wherein at least a portion of each of the plurality of walkway support bars extends beyond the chassis when plurality of walkway support bars are received within the channels of the plurality of walkway support sleeves and secured against the mounting rail portion.

13. The walkway of claim 12, wherein the walkway assembly includes:

a handrail assembly, the handrail assembly including a plurality of handrail elements and a plurality of upright stanchions.

14. The walkway of claim 13, wherein each of the plurality of upright stanchions is coupled to at least one handrail element and one of the plurality of walkway support bars.

15. The walkway of claim 1, further comprising a plurality of parapet modules, each of the plurality of parapet modules being coupled to the walkway assembly.

16. The walkway of claim 15, wherein each of the plurality of parapet modules includes:

a panel; and a mounting frame coupled to the panel and the walkway assembly.

17. A walkway for use with a cooling system, the walkway comprising:

a chassis, the chassis including:

a frame portion, the frame portion being configured to be integrated with the cooling system such that the frame portion defines at least a portion of a frame of the cooling system when the walkway is in use, the frame portion including a plurality of frame elements;

a mounting rail portion coupled to the frame portion; and a plurality of walkway support sleeves coupled between the frame portion and the mounting rail portion, each of the plurality of walkway support sleeves defining a channel;

a plurality of walkway support bars, each of the plurality of walkway support bars having a first end and a second end opposite the first end and being configured to be received within the channel of a corresponding one of the plurality of walkway support sleeves and secured against the mounting rail portion, each of the walkway support bars being wider than the chassis such that each of the walkway support bars extends bilaterally beyond the frame portion; and a walkway assembly coupled to the chassis, the walkway assembly including:

a plurality of walkway platforms, at least some of the plurality of walkway platforms being supported by the at least a portion of each of the walkway support bars that extends beyond the frame portion;

a plurality of upright stanchions, each of the first end and the second end of each of the plurality of walkway support bars being coupled to a different one of the plurality of upright stanchions; and a handrail element coupled to each of the plurality of upright stanchions.

18. The walkway of claim 17, further comprising a plurality of mounting feet coupled to the mounting rail portion of the chassis.

19. The walkway of claim 17, further comprising a plurality of parapet modules, each of the plurality of parapet modules being coupled to the walkway assembly and including:

a panel; and a mounting frame coupled to the panel and the walkway assembly.

* * * * *